United States Patent [19]

Focke et al.

[11] 4,368,859

[45] Jan. 18, 1983

[54] BOBBIN ENGAGING AND LIFTING MECHANISM

[75] Inventors: Heinz H. Focke, Verden; Hans-Jürgen Bretthauer, Bremen, both of Fed. Rep. of Germany

[73] Assignee: Focke & Co., Verden, Fed. Rep. of Germany

[21] Appl. No.: 214,160

[22] Filed: Dec. 8, 1980

[30] Foreign Application Priority Data

Dec. 20, 1979 [DE] Fed. Rep. of Germany ..... 2951301

[51] Int. Cl.[3] ..... B65H 49/02; D03J 5/08

[52] U.S. Cl. ..... 242/130; 242/64; 242/129.51

[58] Field of Search ..... 242/68.4, 79, 129.5, 242/129.51, 129.53, 64

[56] References Cited

U.S. PATENT DOCUMENTS 3,204,887 9/1965 Hansen ..... 242/64

FOREIGN PATENT DOCUMENTS 551075 5/1932 Fed. Rep. of Germany .
1203085 10/1965 Fed. Rep. of Germany .
2548097 5/1977 Fed. Rep. of Germany .
504220 4/1939 United Kingdom ..... 242/129.51

*Primary Examiner*—Leonard D. Christian
*Attorney, Agent, or Firm*—Sughrue, Mion, Zinn, Macpeak and Seas

[57] ABSTRACT

A mechanism for engaging a resting bobbin 10 carrying a web of packaging material and raising it into a rotatable web withdrawal position. A pair of bent yoke arms 17,18 straddling the bobbin carry lateral clamping jaws 14,15 at their one ends. Their other ends are movably pivotally mounted to a plate 11 by a pair of support plates 29,30 and a pair of lifting plates 25,26, the latter being eccentrically coupled to meshing drive gears 20,21. The continuous rotation of the gears successively pivots the jaw ends of the yoke arms inwardly to engage the bobbin, and thereafter raises the arms and bobbin into the working position.

7 Claims, 5 Drawing Figures

BOBBIN ENGAGING AND LIFTING MECHANISM

BACKGROUND OF THE INVENTION

The invention relates to a holder for bobbins (coil rolls) of packing material on packing machines and the like, where the bobbin has a central opening for connection of the holder and can be lifted by the said holder from a support (floor) and moved into the working position.

In many packing machines the blanks to be processed are produced directly by the packing machine by being separated from a web of packing material. This is true especially of relatively thin-walled packing material which is drawn off from a bobbin, that is to say from a roll of packing material. In the case of packing material with a high net weight and/or in the production of large-volume packs with a corresponding packing material requirement, the bobbins to be conveyed to the packing machines are of a correspondingly large size and, consequently, heavy in weight.

It is known to pass an axle as a carrying device through the central through-opening of the bobbin. The laterally projecting ends of this axle are gripped by a hydraulic lifting appliance which, by lifting the axle, moves the bobbin into a working position. In this position the axle lies with its ends in a bearing formed on the machine frame. The packing material can now be drawn off from the rotatable bobbin. The abovementioned known arrangement is expensive to manufacture and is susceptible to faults in operation, since at least two lifting cylinders, which are loaded with pressure medium and which must be moved synchronously, are required.

SUMMARY OF THE INVENTION

The object of the invention is therefore to propose a holder for bobbins in connection with packing machines and the like, the said holder being of simplified construction, but being easy to handle and reliable in operation.

To achieve this object, the holder according to the invention is characterised in that two laterally engaging holding devices (clamping jaws) can, in successive phases of movement, be moved into engagement with the bobbin and can be lifted together with the latter by means of a lifting mechanism.

Accordingly, the holder according to the invention has a twofold function, in that it picks up the bobbin from a supporting surface, especially from the floor, conveys it into the working position and holds it in this position for the drawing off of the packing material. At the same time, the bobbin is mounted on the holding devices so that it is rotatable in the working position.

Preferably, the moving elements of the lifting drive are exclusively mechanical and can be moved by means of an operating lever to be actuated manually. This lever is combined with a lifting mechanism in such a way that the bobbin can both be gripped and subsequently lifted into the working position with the use of a small force.

According to a further feature of the invention, the holder is equipped with clamping jaws which are arranged on pivotable and liftable supporting arms and which are movable into a frictional or positive connection with the bobbin. The supporting arms are moved by a lifting mechanism in such a way that, during a first phase of movement, the clamping jaws are moved into engagement with the bobbin and then, as the movement continues, the supporting arms are lifted together with the picked-up bobbin.

After the clamping jaws have engaged with the opening of the bobbin, gear elements are displaced, upon continued operation of the lifting mechanism, in such a way that, while the engagement of the clamping jaws is maintained, the clamping jaws are moved upwards together with the bobbin.

The gear according to the invention is relatively unsusceptible to faults, can be heavily loaded and is simple to supervise.

BRIEF DESCRIPTION OF THE DRAWINGS

An illustrative embodiment of the holder according to the invention is described in more detail below with reference to the drawings in which.

DETAILED DESCRIPTION OF THE PREFERRED EMBODIMENTS

Figure 1:
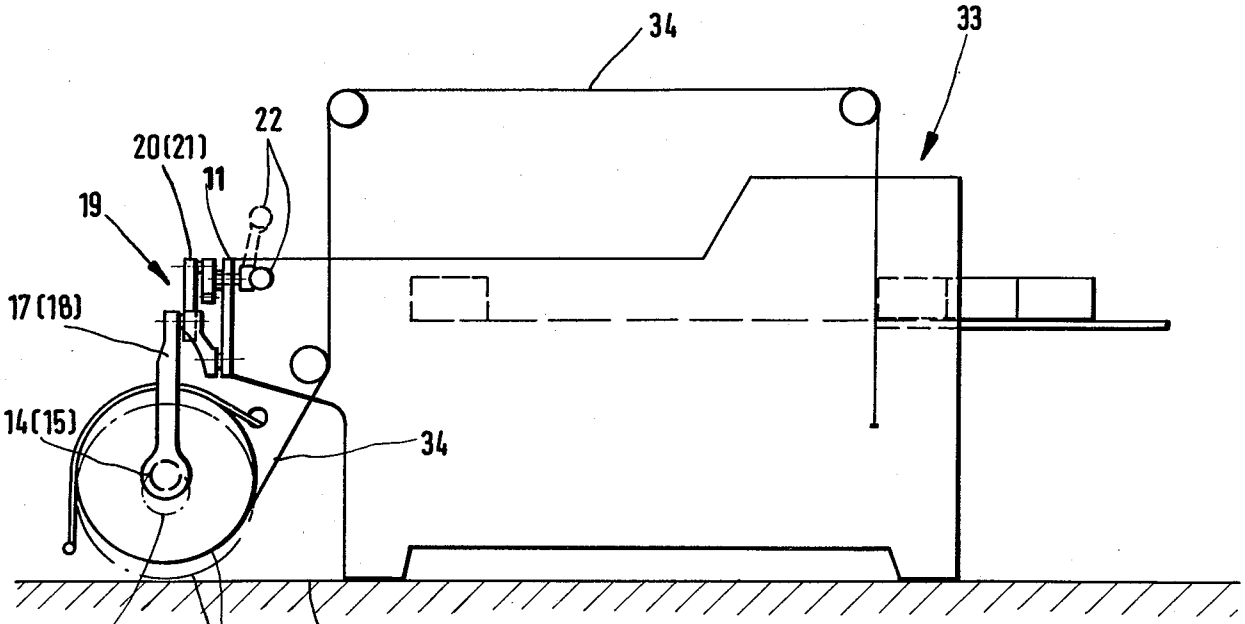
FIG. 1 is a view which a holder for a bobbin in conjunction with a packing machine illustrated diagrammatically.
Figure 2:
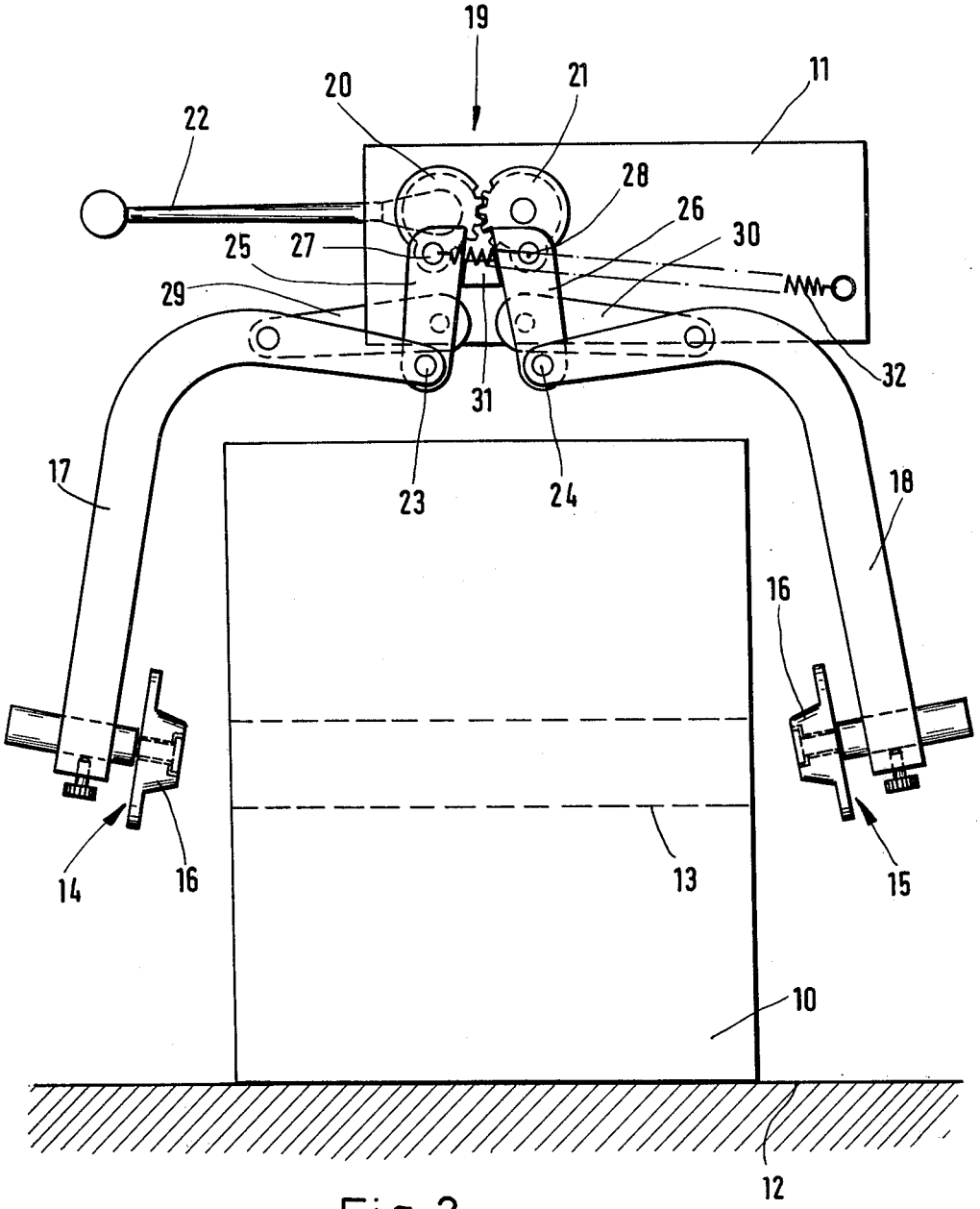
FIG. 2 is a view which the holder as a detail in front view, as the bobbin is picked up.
Figure 3:
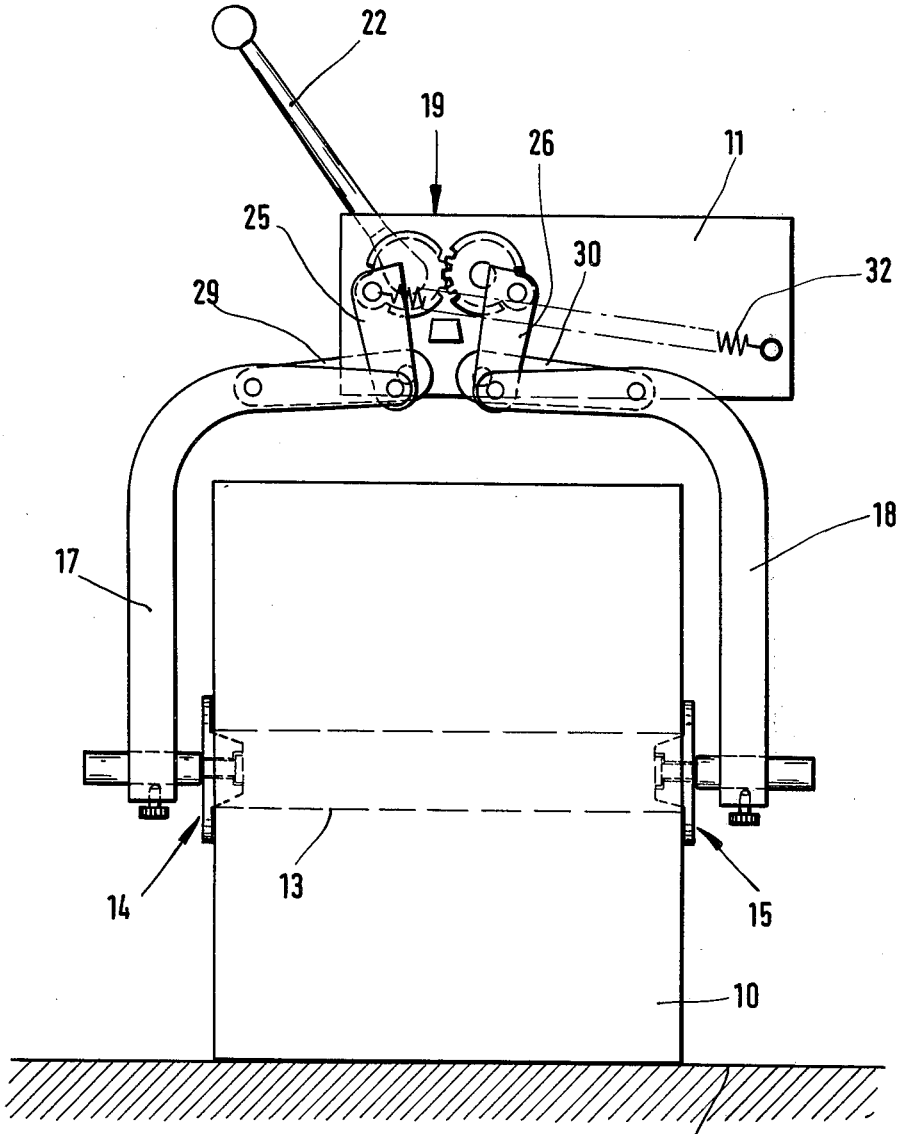
FIG. 3 is a view which the holder according to FIG. 2 with carrying devices coupled to the bobbin.
Figure 4:
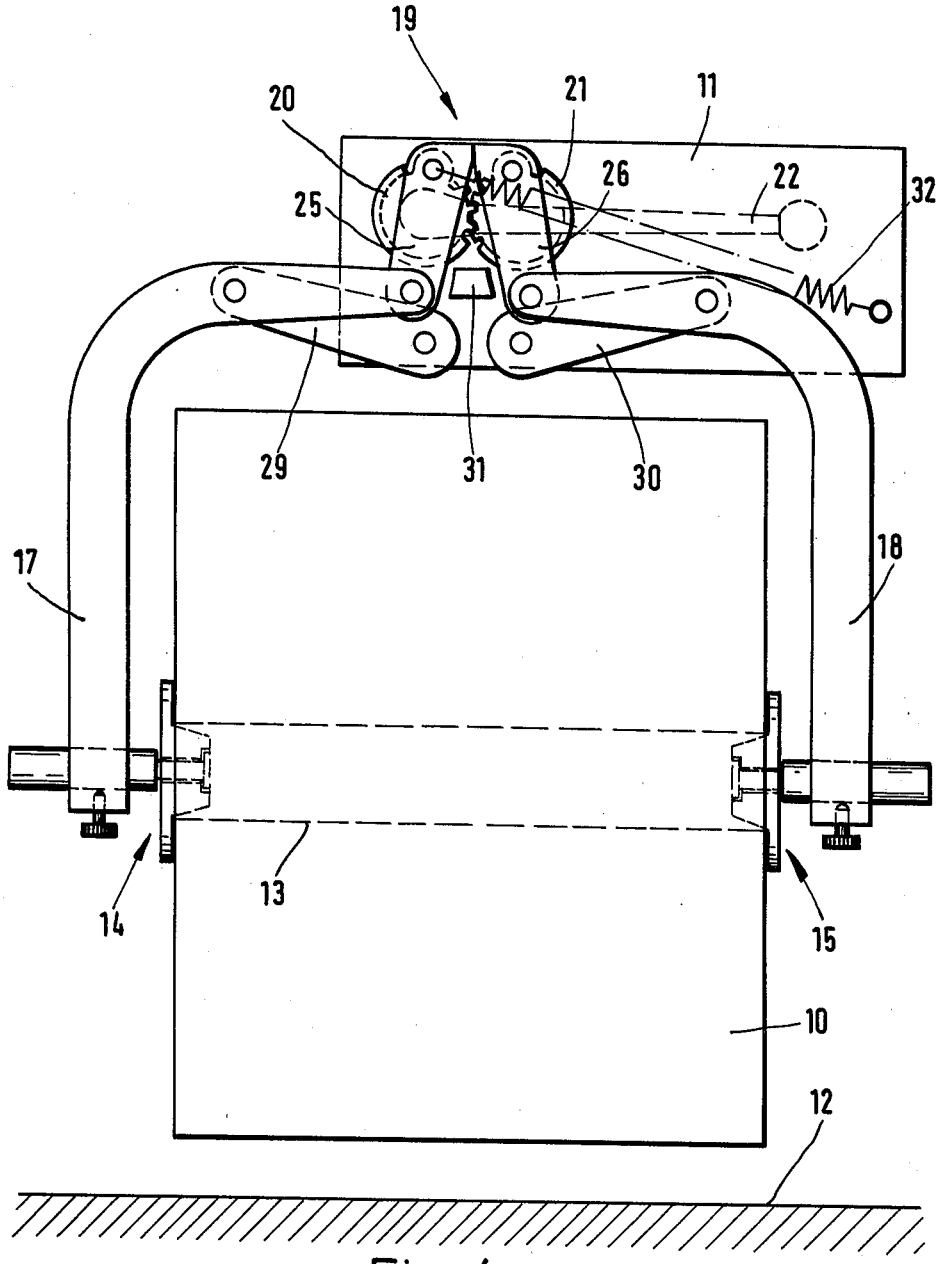
FIG. 4 is a view which the holder according to FIGS. 2 and 3 with the bobbin in its end position or working position.
Figure 5:
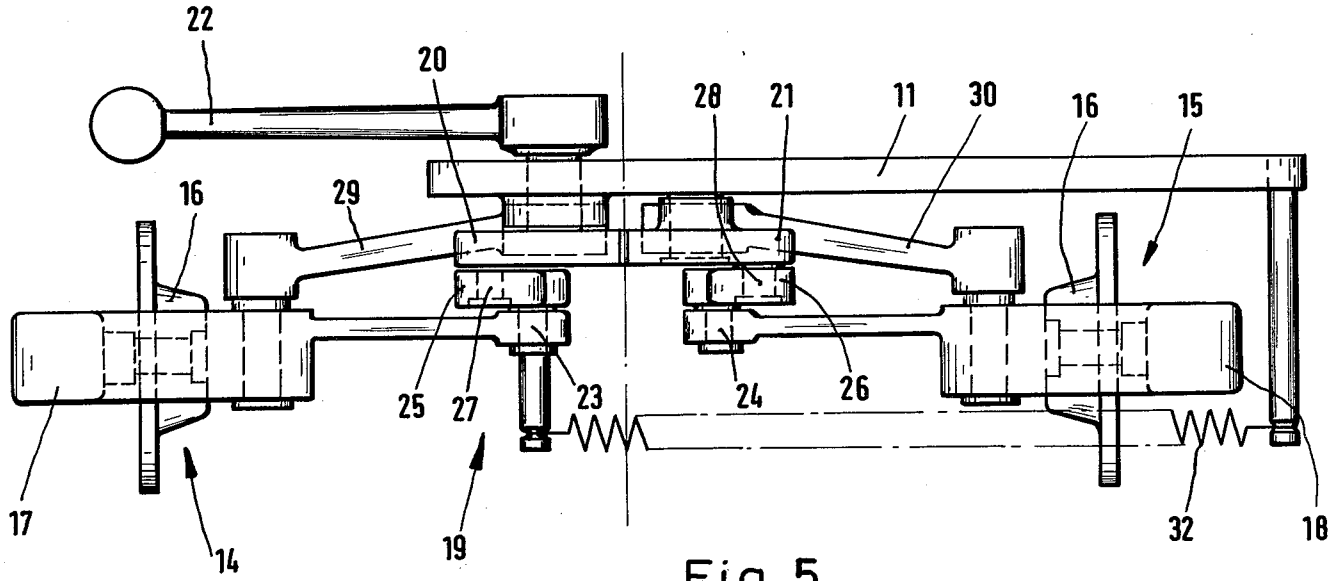
FIG. 5 is a side of transverse view of the holder.

FIGS. 2 to 4 illustrate an illustrative embodiment of a holder for picking up and supporting a bobbin 10, as a detail, in various positions. Here, this holder is attached by means of a carrier in the form of a support plate 11 to a diagrammatically illustrated packing machine 33 (FIG. 1), or to its machine frame. In the lifted (working) position, a web 34 of packing material is drawn off from the bobbin 10.

When being picked up by the holder or by the packing machine 33, the bobbin 10 is located on a support, in the present case on the floor 12. The bobbin 10 is provided with a central through-opening 13. In the present case, this opening is used for attaching the holder. Clamping jaws 14 and 15, each with a cone 16, penetrate into the two ends of the opening 13 in a frictional and positive manner.

The clamping jaws 14 and 15 are arranged adjustably and rotatably, namely about the longitudinal axis running through the opening 13, on the lower free end of a supporting arm 17 and 18 respectively. By means of this mounting of the clamping jaws 14, 15, the bobbin 10 is rotatably supported on the supporting arms 17 and 18. Here, these are made stirrup-shaped and surround the bobbin 10 from above in such a way that the clamping jaws 14, 15 are situated at the height of the opening 13.

In the starting position (FIG. 2), the supporting arms 17, 18 are swung back to the side, so that they can be lowered, together with the clamping jaws 14, 15, over the bobbin 10 from above. The two supporting arms 17, 18 are then pivoted in opposite directions, as a result of which the clamping jaws 14 and 15 engage with the opening 13 (FIG. 3). Upon further operation of the holder, the supporting arms 17 and 18 are moved upwards in a stepless movement, carrying the bobbin 10 along into its working position according to FIG. 4.

To execute the abovementioned movement, in the present illustrative embodiment, the supporting arms 17, 18 are actuated by a mechanical lifting mechanism 19. This includes two gear wheels 20 and 21 which are rotatably mounted on the support plate 11 and which mesh with one another. The gear wheels 20, 21 are turned to and fro in common, namely by means of an operating lever 22 which acts on the gear wheel 20. Here, the operating lever 22 is to be actuated by hand and is made to a length suitable for the transmission of a sufficient force.

The ends, facing the lifting mechanism 19, of the supporting arms 17 and 18 are each pivotably connected in a joint 23, 24 to a lifting plate 25 and 26. The lifting plates 25, 26 are, in turn, coupled to the gear wheels 20, 21 via pivot bearings 27, 28 and, specifically, in such a defined relative position that the pivot bearings 27, 28 are directed downwards in the starting position (FIG. 2) and substantially upwards in the opposite end position (FIG. 4).

The supporting arms 17, 18 are connected indirectly to the support plate 11, namely via retaining plates 29, 30. These are hinged respectively to the supporting arms 17, 18, namely in a region remote from the joints 23, 24 or the ends of the supporting arms 17, 18. The other ends of the retaining plates 29, 30 are pivotably connected to the support plate 11 in its lower region.

In the starting position of the holder according to FIG. 2, the lifting plates 25, 26 are in their lower end position due to the corresponding relative position of the gear wheels 20, 21. Accordingly, the ends of the supporting arms 17, 18, connected to these lifting plates 25, 26, are pivoted downwards. The retaining plates 29, 30 are directed approximately horizontally. This starting position of the lifting mechanism 19 is maintained by means of a retaining device in the form of a stay 31 which is attached to the support plate 11 approximately centrally between the lifting plates 25, 26 and against which the lifting plates 25, 26 bear.

A pivoting movement of the operating lever 22, which projects transversely in the starting position, into a position according to FIG. 3, with corresponding turning of the gear wheels 20, 21, causes the lifting plates 25, 26 to rise and, with them, the adjacent ends of the supporting arms 17, 18. During this, the retaining plates 29, 30 remain substantially in the starting position according to FIG. 2.

The abovementioned first phase of movement results in the supporting arms 17, 18 being pivoted in a clockwise and anti-clockwise direction respectively, until the clamping jaws 14, 15 engage with the bobbin 10.

Upon further movement of the operating lever 22 into the position according to FIG. 4, the lifting plates 25, 26 are substantially moved upwards to their upper end position, namely until they make contact with one another. During this phase of movement, the supporting arms 17, 18 execute substantially a translatory upward movement as a result of the bracing by the retaining plates 29, 30, and carry along with them, that is to say lift, the bobbin 10. During this, the retaining plates are likewise pivoted in opposite directions.

The abovementioned end positions according to FIGS. 2 and 4 are fixed in the one and in the other direction by means of loading the mechanism with reversible effect. In the present case, a tension spring 32 is fastened with one end to the support plate 11 and with the other end to the pivot bearing 27 for the lifting plate 25. Owing to the relative positions selected, the spring force always acts in the direction of the end positions of the lifting gear 19. A dead centre position is crossed approximately in the position according to FIG. 3.

The lifting mechanism 19 is geared down in relation to the pivoting movements of the operating lever 22 as a result of the sizing of the gearing parts, especially of the gear wheels 20, 21, so that heavyweight bobbins 10 can be handled with the use of a small force.

I claim:

1. A mechanism for engaging a bobbin (10) carrying a web (34) a packaging material and raising said bobbin from a rest position on a support (12) to a working position whereat the web may be withdrawn, comprising:

(a) a pair of yoke arms (17,18) disposed in a common plane for straddling a bobbin, (b) a pair of clamping jaws (14,15) individually and rotatably mounted on one end of said yoke arms for laterally and axially engaging said bobbin, (c) a mounting plate (11), (d) movable first pivot means (29,30) mounting each yoke arm to said mounting plate intermediate its ends, (e) rotatable drive means (20,21) mounted on said mounting plate, and (f) movable second pivot means (25,26) eccentrically coupling said drive means to other ends of said yoke arms, whereby the continuous rotation of said drive means successively pivots the one ends of the yoke arms inwardly to bring the clamping jaws into engagement with the bobbin and thereafter raises the yoke arms and engaged bobbin from a rest position to a rotatable working position.

2. A mechanism as defined in claim 1, wherein the clamping jaws are conically shaped and self-centering.

3. A mechanism as defined in claim 1, wherein the drive means comprises a pair of toothed gears meshing with each other for rotation in opposite directions, and the second pivot means comprises a pair of lifting plates individually pivotally mounted between eccentric positions on said gears and said other ends of the yoke arms.

4. A mechanism as defined in claim 3, wherein said first pivot means comprises a pair of support plates individually pivotally mounted between positions on said yoke arms intermediate their ends and positions on said mounting plate below said gears and spaced the same distance apart.

5. A mechanism as defined in claim 3 or 4, further comprising a fixed stop member (31) mounted on the mounting plate intermediate the lifting plates for abutment thereby to limit the inward movement of the lifting plates in the rest position of the bobbin.

6. A mechanism as defined in claim 3 or 4, further comprising mutually engaging abutment surfaces on said lifting plates for limiting their inward movement in the raised position of the bobbin.

7. A mechanism as defined in claim 1, 3 or 4, further comprising tension spring means (32) coupled between said mounting plate and said second pivot means for biasing the mechanism into two terminal positions.

* * * * *